US005384996A

United States Patent [19]

Nicholas

[11] Patent Number: 5,384,996

[45] Date of Patent: Jan. 31, 1995

[54] ARCHITECTURAL JOINT SYSTEM WITH ARCHED COVER PLATE

[75] Inventor: John D. Nicholas, Lawrenceville, Ga.

[73] Assignee: Pawling Corporation, Pawling, N.Y.

[21] Appl. No.: 154,999

[22] Filed: Nov. 18, 1993

Related U.S. Application Data

[63] Continuation of Ser. No. 919,594, Jul. 24, 1992, abandoned.

[51] Int. Cl.[6] ..... E04B 1/68

[52] U.S. Cl. ..... 52/468; 52/396.05; 404/57

[58] Field of Search ..... 52/396, 468; 404/57, 404/50, 62, 68

[56] References Cited

U.S. PATENT DOCUMENTS

| | | | |
|---|---|---|---|
| 3,750,359 | 8/1973 | Balzer et al. . | |
| 5,051,024 | 9/1991 | Warthmann | 52 X/396 |
| 5,060,439 | 10/1991 | Clements | 52/396 |
| 5,067,297 | 11/1991 | Sobol | 52/396 |

OTHER PUBLICATIONS

Excerpt from Balco Inc., Catalog "6000 Series".

*Primary Examiner*—Carl D. Friedman
*Assistant Examiner*—Beth A. Aubrey
*Attorney, Agent, or Firm*—Schweitzer Cornman & Gross

[57] ABSTRACT

An architectural joint system is disclosed, which incorporates a slidably supported arched cover plate to span the open space between two relatively movable structural units. The edge margins of the arched cover plate are slidably received in housings, mounted at the adjacent corners of the structural units. The housing assemblies are formed of base members and cover members assembled to define a narrow gap for the reception of a thin cover plate, and an enclosure for receiving the edges of the plate. The cover members are uniquely designed to have an outwardly and upwardly convergent taper, extending over a substantial distance of at least about two times the thickness of the cover member. The arched plate is of a shallow, upwardly convex contour, closely conforming to the long convergent taper of the cover member. The new construction is a significant improvement over known arched cover type joint systems, in that it presents a substantially inconsequential deviation from a flat, planar surface of the adjacent structures, an important advantage in the construction of floors for hospitals and similar institutions.

1 Claim, 2 Drawing Sheets

ARCHITECTURAL JOINT SYSTEM WITH ARCHED COVER PLATE

RELATED APPLICATIONS

This application is a continuation of my prior copending application Ser. No. 919,594, filed Jul. 24, 1992, now abandoned.

BACKGROUND AND SUMMARY OF THE INVENTION

Architectural structures frequently are constructed to comprise a plurality of separate architectural units, with a space provided between to accommodate normal relative movements resulting from expansion and contraction, for example, and in some cases from seismic activity. One of the known types of such architectural joint systems employs an arched cover plate, which extends between and has its opposite side margins slidably received in housings provided at the edges of the adjacent structural units. As the structural units toward and away from each other, the side edge margins of the arched cover plate can move into and out of the respective housings at each side, within the design limits of the joint system, maintaining a continuous cover over the open space between the structural units. U.S. Pat. No. 3,750,359 is representative of such joint systems.

The above invention is directed to specific and valuable improvements in architectural joint systems of the type described above, rendering the joint systems particularly desirable and advantageous for use in connection with floor joints in hospitals and similar institutions, for example. In accordance with the invention, the design of the joint system is such that the arched cover and its mounting means present an almost imperceptible deviation from the smooth surfaces of the adjacent structural units. This is particularly desirable and important in areas where wheelchairs, stretchers, and the like pass regularly, and there is accordingly a need to avoid bumping and jarring. The structure of the present invention is highly simplified, and economical to manufacture, yet is significantly advantageous over known designs of the same general type.

For a more complete understanding of the above and other features and advantages of the invention, reference should be made to the following detailed description of a preferred embodiment of the invention and to the accompanying drawings.

DESCRIPTION OF A PREFERRED EMBODIMENT OF THE INVENTION

Figure 1:
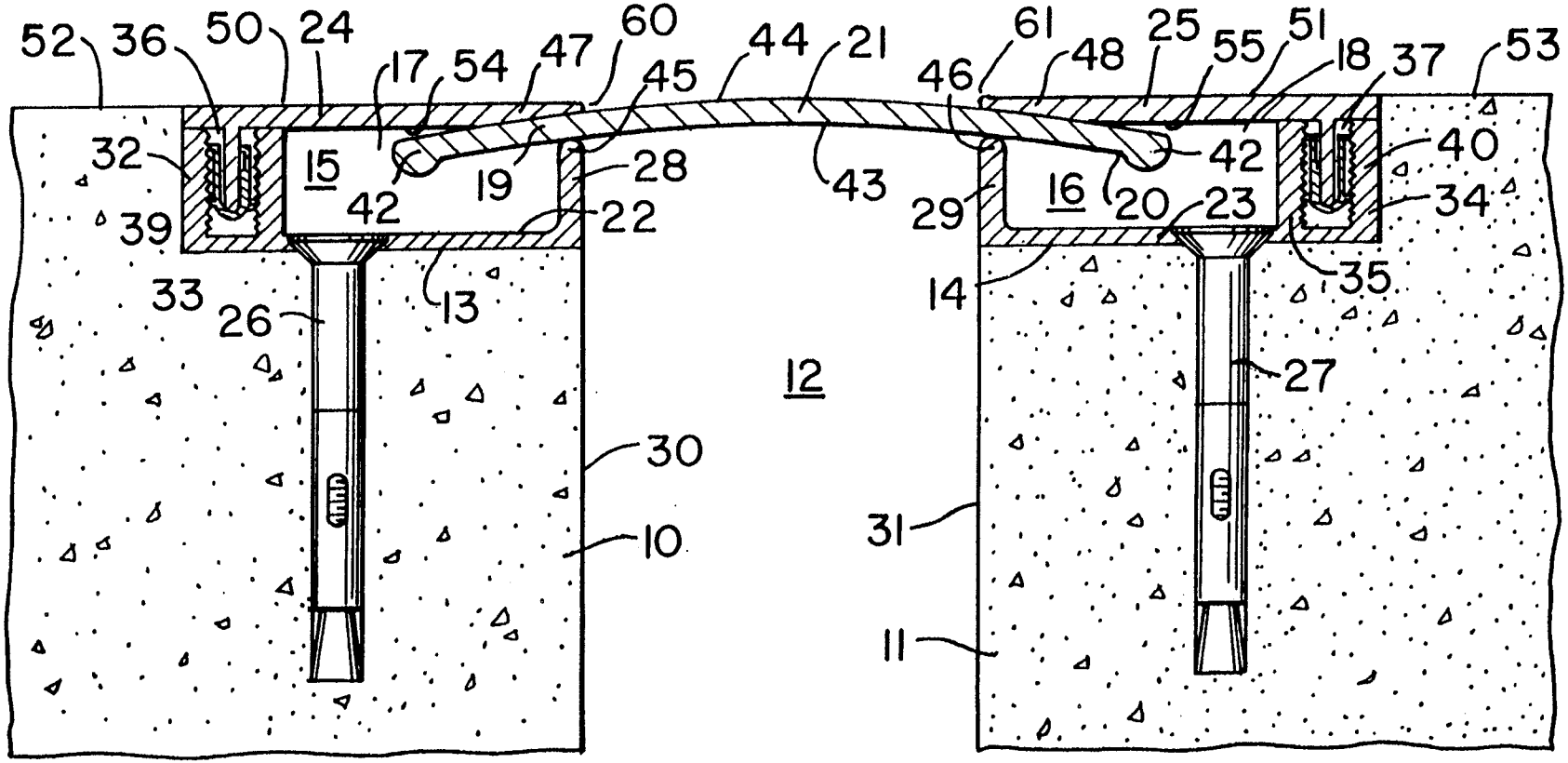
FIG. 1 is a cross sectional view of an architectural joint system incorporating an arched cover plate and mountings therefor, constructed in accordance with the principles of the invention.

Referring now to the drawing, the reference numerals 10, 11 designate generally a pair of adjacent structural units separated by a space 12. The illustrated space is a nominal predetermined space to accommodate relative motion of the structural units 10, 11 toward and away from each other, within predetermined design limits. Such relative motion typically results from expansion and contraction, for example, and also from seismic activity.

In the illustrated form of the invention, the structural units 10, 11 typically are adjacent floor sections, where the present invention is useful to particular advantage. However, the invention is not to be considered as being limited to floor structures.

Each of the adjacent structural units 10, 11 is formed with a block-out section 13, 14 in an upper, inner corner area. Housings 15, 16 are mounted in these block-out areas, each defining a hollow enclosure 17, 18 for the reception of edge margins 19, 20 of an arched cover plate 21, which spans over the open space 12 between the structural units.

Figure 2:
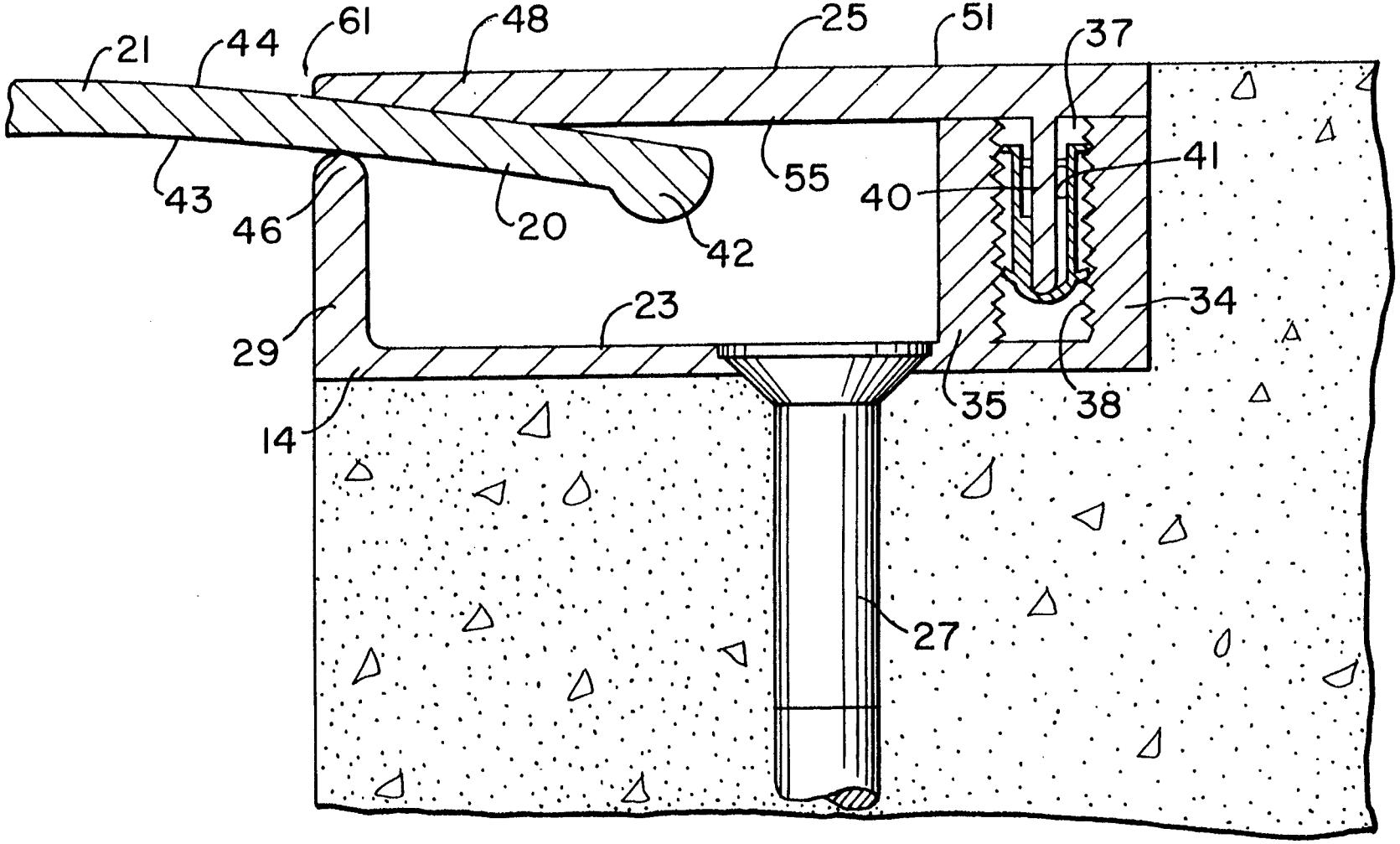
FIG. 2 is a highly enlarged, fragmentary view of a portion of the structure of FIG. 1, illustrating details of construction.

The respective housings 15, 16 are comprised of base members 22, 23 and covers 24, 25. The respective base members 22, 23 are rigidly secured to the structural units 10, 11, as by means of anchor bolts 26, 27. Each base member includes an upwardly projecting inner flange wall 28, 29, arranged to be generally co-planar with the opposed surfaces 30, 31 of the structural units 10, 11, defining the space 12. The outer portions of the housing bases 22, 23 are formed by spaced apart, upwardly extending flanges 32, 33, and 34, 35, forming upwardly opening recesses 36, 37, advantageously provided with serrated edges, as shown at 38 in FIG. 2, forming a continuous threaded slot.

In the illustrated form of the invention, the cover members 24, 25 are provided with downwardly extending flanges 39, 40 respectively, which are receivable in the recesses 36, 37. Clip devices 41 (FIG. 2), preferably Tinnerman clips, are interposed between the flanges 40 and the serrated walls 38 of the recesses 36, 37, to tightly grip the respective elements of the base and cover. Accordingly, when the cover members 24, 25 are assembled together with their respective base members 22, 23, the assembly is substantially permanent. At the same time, the clip connection, afforded by the Tinnerman clip 41, allows a slight freedom of motion between the base and cover parts of a housing assembly, as may be necessary to accommodate certain relative motions of the respective structural units. If desired, the flanges 39, 40 may be eliminated, and the cover members 24, 25 may be secured by screws, received in the threaded recesses 36, 37.

The base and cover members, forming the housings 15, 16, typically are of uniform cross section throughout their length, and are advantageously produced by continuous extrusion of aluminum, for example.

The arched cover plate 21 typically is a thin section of extruded or formed rigid metal material such as aluminum, of substantially uniform thickness and typically provided with ribs or flanges 42 at each end, projecting downward from the lower surface 43 of the plate. The upper surface 44 of the cover plate desirably is smooth and even in its contours, especially at the side edge margins, but also preferably in the center as well. As shown in FIG. 1, the cover plate 21 is of a relatively long radius, arcuate contour, preferably having a radius of curvature at least about two times the width of the cover plate.

As shown in the drawings, the outer side margins of the cover plate 21 are supported by the upper extremities 45, 46 of the flange walls 28, 29, which slidably engage the arcuate bottom surface 43 of the cover plate. A predetermined gap, having substantially the thickness of the cover plate 21, is defined by the free end regions 47, 48 of the respective housing cover members 24, 25 and the flange walls 28, 29. The arrangement is such that the arched cover plate 21 is free to slide with respect to the housings 15, 16 as the structural units 10, 11 move toward and away from each other.

In accordance with the invention, the free end regions 47, 48 of the cover members are formed in a manner to reduce to relative insignificance any unevenness in the surface presented by the architectural joint system. In particular, where the architectural units 10, 11 constitute a floor of a hospital or similar institution, as contemplated, the upper principal surfaces 50, 51 of the cover members should constitute a co-planar extension of the floor surfaces 52, 53, which can be accomplished, of course, by proper mounting of the housing assemblies. In addition, the upper surface 44 of the arched cover plate should present an absolute minimum departure from a co-planar relation to the upper principal surfaces 50, 51 of the cover members 24, 25. In accordance with the invention, this is realized by providing for the lower principal surfaces 54, 55 of the housing cover members to be inclined upwardly and outwardly toward the flat upper principal surfaces 50, 51 at the respective free end regions 47, 48 of the cover members.

Significantly, the tapered free end region 47, 48 of each housing cover member extends over a distance constituting a multiple of at least two times the thickness of the cover at a point adjacent to said free end region in order to provide a relatively shallow cross section contour. Additionally, the amount of the taper is greater than half the thickness of the cover member adjacent said free end region. The tapered ends of the housing covers may be quite thin, as they are supported directly by the underlying portions of the arched cover plate 21. Accordingly, there is an absolute minimum departure from the planar surfaces 50, 51 of the housing cover member, in the immediate area 60, 61 of the juncture between the housings 15, 16 and the arched cover plate 21. Additionally, by reason of the gentle upwardly convex, long-radius curvature of the cover plate 21, the upper surface 44 of the cover plate presents a minimum departure from a flat surface, and the uppermost extremity of the arched cover plate, i.e., at the center of the arch, closely matches the level of the floor surfaces 52, 53.

The provision of the long-tapered, upwardly convergent free end configuration of the housing cover members is a significant and novel feature in the construction of an arched plate architectural joint system, especially where the joint system is to be employed in the floor of a hospital or similar institution, where bumps and roughness in the floor may cause pain and discomfort to a patient moved along a wheeled apparatus. In the system of the present invention, the free end regions of the housing cover members are upwardly convergent over a substantial distance, not less than twice the thickness of the cover member in the region adjacent to the tapered free end. Likewise, the arched cover plate is conformed substantially to a long radius arc, at least about two times the width of the plate. This enables the arched cover plate to conform closely to the upwardly convergent tapered configuration of the cover member free end regions. These contours can be closely approximated in other ways, such as by forming the cover plate 21 in the form of an extremely shallow inverted Vee. Regardless of the specific contours, the general contour of the arched cover plate should be slightly arched, so that the center portion of the cover plate lies in or very close to the plane of the floor surfaces 52, 53, when the space 12 between the structural units is of "normal" magnitude. The center portion of the cover plate will rise slightly as the structural units separate, and lowers slightly as they move together. Nevertheless, because of the long, upwardly convergent taper of the housing cover members, and the shallow upwardly convex contours of the cover plate, a smooth continuity between the structural floor surfaces 52, 53 and the upper surface 44 of the cover plate is assured.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. An arched plate cover assembly for an architectural joint, particularly for joining floor surfaces of a pair of relatively movable adjacent structural units separated by a space and providing a smooth continuity between said floor surfaces, which comprises (a) spaced apart first and second housing assemblies mounted on each of said structural units, (b) each of said housing assemblies including a base member, secured rigidly to its structural unit, and a cover member, (c) said base and cover members forming hollow enclosures, (d) each said base member including an outer flange wall projecting upwardly toward the cover member and defining a predetermined gap between an upper end of said flange wall and a free end region of said cover member, (e) said outer flange walls being spaced apart and defining an open space between them, (f) an arcuately arched cover plate of predetermined width, formed of rigid material, having an exposed and unsupported center portion spanning the open space between said flange walls and having opposite side edge margins closely movably received at each side in said gaps and slideably projecting at opposite sides into each of said enclosures whereby the exposed and unsupported center portion of said arched cover plate is caused to rise slightly when said structural units separate and to lower slightly when said structural units move toward each other, (g) said arched cover plate being of upwardly convex, generally arcuate and relatively shallow cross sectional contour conforming substantially to a long radius arc, with the radius of said arc being at least about two times the width of said cover plate, (h) the cover members of said first and second housing assemblies being of predetermined thickness and having upper and lower principal surfaces, (i) the upper principal surface of each cover member being generally flat and generally coextensive with an outer surface of the structural unit in which it is mounted, (j) the lower principal surface of each cover member being inclined upwardly and outwardly toward said upper principal surface in said free end region to form an upwardly convergently tapered free end region, (k) the tapered free end region of each cover member directly overlying the upper ends of said outer flange walls to define said gaps, (l) said tapered free end regions extending over a distance constituting a multiple of at least two times the thickness of the cover member at a point adjacent to its free end region and being tapered by an amount greater than half the thickness of the cover member adjacent to said free end region, (m) said arched cover plate having its outer surface closely conforming to outwardly tapering contours of said lower principal surface portions in said free end region and having its inner surface supported on upper end edges of said outer flange walls, (n) said arched cover plate being supported substantially exclusively by the upper ends of said outer flange walls, (o) the upwardly convergently tapered free end regions of said cover members extending inwardly from said flange walls to a point substantially removed therefrom, (p) said convergently tapered free end regions having relatively thin end extremities, and (q) said end extremities being directly supported by the rigid material of underlying portions of said arched cover plate, to provide minimum departure from a flat surface.

* * * * *